US006250712B1

(12) United States Patent
Livington et al.

(10) Patent No.: US 6,250,712 B1
(45) Date of Patent: Jun. 26, 2001

(54) FOLDABLE CHAIR

(75) Inventors: B. Bruce Livington, Cottondale; Barry B. Livington; Mark S. Farmer, both of Eutaw, all of AL (US)

(73) Assignee: LongBeard Industries, L.L.C., Eutaw, AL (US)

( * ) Notice: Subject to any disclaimer, the term of this patent is extended or adjusted under 35 U.S.C. 154(b) by 0 days.

(21) Appl. No.: 09/135,072

(22) Filed: Aug. 17, 1998

(51) Int. Cl.[7] ..... A47C 1/00; A47C 1/14; A47C 9/10

(52) U.S. Cl. ..... 297/4; 297/17; 297/22; 297/129; 297/377; 297/632; 297/633; 297/634

(58) Field of Search ..... 297/377, 382; 5/632, 633, 634, 4

(56) References Cited

U.S. PATENT DOCUMENTS

| | | | | |
|---|---|---|---|---|
| 1,842,424 | * | 1/1932 | Ponten et al. | 297/377 |
| 3,292,189 | * | 12/1966 | Parker et al. | 5/634 X |
| 3,808,616 | * | 5/1974 | White | 297/377 X |
| 4,375,901 | * | 3/1983 | MacDonald | 297/377 |
| 4,654,907 | * | 4/1987 | Haugaard | 297/377 X |
| 5,121,961 | * | 6/1992 | Marshall | 5/632 X |
| 5,272,777 | * | 12/1993 | Favagrossa | 297/377 X |
| 5,396,674 | * | 3/1995 | Bolds | 5/633 |
| 5,409,291 | * | 4/1995 | Lamb et al. | 297/129 |
| 5,425,567 | * | 6/1995 | Albecker, III | 297/377 |
| 5,588,696 | * | 12/1996 | Jay et al. | 297/129 |
| 5,755,492 | * | 5/1998 | Iver | 297/377 |
| 5,882,079 | * | 3/1999 | Yang | 297/377 |

FOREIGN PATENT DOCUMENTS

| | | | | |
|---|---|---|---|---|
| 494515 | * | 7/1950 | (BE) | 297/22 |
| 277939 | * | 9/1951 | (CH) | 297/17 |
| 995277 | * | 11/1951 | (FR) | 297/377 |
| 1088925 | * | 3/1955 | (FR) | 297/377 |
| 1167623 | * | 11/1958 | (FR) | 297/377 |

OTHER PUBLICATIONS

Advertisement in the Turkey and Turkey Hunting Magazine, Feb. 1997, p. 51.
Advertisement in the Turkey and Turkey Hunting Magazine, Feb. 1997, p. 63.

* cited by examiner

*Primary Examiner*—Peter M. Cuomo
*Assistant Examiner*—Rodney B. White
(74) *Attorney, Agent, or Firm*—Thomas, Kayden, Horstemeyer & Risley, LLP

(57) ABSTRACT

A foldable chair generally comprising a frame, an upper body support, a lower body support, and a frame support. The frame preferably comprises a plurality of tubes that are connected to form the general outline of a rectangle. The upper body support is connected to the frame and also joins the lower body support through a central web of material. The frame support is pivotally connected to the upper tube of the frame. Further provided is a pair of adjustable shoulder straps that extend from the upper tube of the frame to the lower tube of the frame which permit the user to easily carry the folded chair on his or her back. When the chair is not needed for seating, the user can fold the frame support and lower body support inwardly toward the upper body support. Once secured in the folded configuration with a retaining strap, the chair can be carried in similar fashion as a backpack.

26 Claims, 6 Drawing Sheets

FOLDABLE CHAIR

FIELD OF THE INVENTION

The invention relates generally to a portable body support. More particularly, the invention relates to a portable, foldable chair well suited for outdoor activities such as hunting, bird watching, and the like.

BACKGROUND OF THE INVENTION

For many years, hunters and outdoor enthusiasts have braved the elements in pursuit of their outdoor sports and hobbies. Several of these outdoor activities involve sitting outside for extended periods of time. Those involved in such activities often bring seat cushions or other pads along with them on their outdoor excursions to ensure that they will have a comfortable and dry place to sit.

Although capable of providing a soft, dry surface to sit on, conventional seat cushions and pads present several drawbacks to the outdoorsman. First, these cushions are often bulky and difficult to carry when the user already has other equipment that must be carried. Second, although providing support for the user's buttocks, these cushions typically provide no support whatsoever for the user's back and head. Therefore, when simple seat cushions or pads are used, discomfort and fatigue can set in quickly. This discomfort and fatigue can be substantial, especially when long periods of time are spent in one particular seated position.

In response to the need for an improved portable body support, a handful of portable chair designs have been introduced into the market. Such chairs, however, have proven to be too bulky and/or too difficult to transport and set-up for the typical outdoor enthusiast. Accordingly, it can be appreciated that it would be desirable to have a portable chair that provides adequate support to the user's body, that is easily transported, and that is easily set-up. The present disclosure describes several variants of one such portable chair.

SUMMARY OF THE INVENTION

The present invention relates to a foldable chair. The foldable chair generally comprises a frame, an upper body support, a lower body support, and a frame support. The frame is normally formed of an upper member, a lower member, and a pair of opposed side members that are typically constructed of PVC tubing. Each of the tubes is connected at both of its ends to an L-shaped member which joins one tube to the next in the frame such that the members are arranged to form the general outline of a rectangle.

The upper body support is typically connected to the opposed side members of the frame and comprises a top side and a bottom side. To increase user comfort, the upper body support is provided with inner padding material which normally comprises sheets of high density polymeric foam. Encasing the padding material is a fabric covering. This fabric is normally constructed of a synthetic material and can be constructed of a substantially waterproof material such as Courdora® if desired.

The upper body support has side portions that each extend outwardly from the top side of the upper body support, around a side member, and to the bottom side of the upper body support. The side portions surround padding material that is disposed about the side members of the frame. To secure the side portions in place on the side member and to prevent dirt and other debris from collecting therebetween, each end of the side portions usually is provided with an elastic cuff.

Extending from the lower end of the upper body support is a central web of material that connects the upper body support to the lower body support. Like the upper body support, the lower body support typically includes interior padding material and an exterior synthetic fabric.

Pivotally connected to the upper member of the frame is the frame support. The frame support preferably comprises opposed elongated side members and a base member that connects to the side members with L-shaped members. Disposed at the ends of the side members most distal to the base member are T-shaped members. These T-shaped members form the pivotal connection between the side members of the frame support and the upper member of the frame. To lower the tolerance between the T-shaped members and the upper member, the T-shaped members are preferably fitted with inner bushings. In a first embodiment, the frame support is relatively large, maintaining the upper body support at an angle approximately between 40 and 60 degrees with respect to the ground or floor surface. In a second embodiment, the frame support is relatively small, maintaining an upper body support angle of approximately between 0 and 30 degrees. In a third embodiment, the frame support is adjustable such that the angle of inclination of the upper body support can be varied.

Extending from the upper portion of the upper body support is a head support. The head support wraps about the upper member of the frame between the two T-shaped members of the frame support. Like the upper and lower body supports, the head support comprises inner padding material covered with a synthetic fabric.

To aid in folding and transport of the chair, the folding chair of the present invention normally includes a plurality of straps. The first of these straps is a frame support securing strap connected at one end to the lower member of the frame and to the base member of the frame support at its other end. Normally, the securing strap is adjustable and comprises two separate segments that are releasably connected to each other with a quick release fastener. When adjusted to the proper length, the securing strap ensures that the base of the frame support will not slip along the ground or floor surface upon which the chair is placed. The second strap is a lower body support retaining strap which is attached to the lower body support and the upper body support. Like the securing strap, the lower body support retaining strap typically includes two separate segments that are releasably connectable with a quick release fastener. The lower body support retaining strap is used to hold the lower body support against the upper body support when the chair is to be transported.

In addition to the above described straps, the foldable chair of the present invention is preferably provided with a pair of adjustable shoulder straps that extend from the upper member to the lower member of the frame. Like the other straps mentioned above, the shoulder straps are formed of two segments that are releasably connected with quick release fasteners. These shoulder straps permit the user to easily carry the folded chair on his or he back for hands-free transport.

The objects, features, and advantages of this invention will become apparent upon reading the following specification, when taken in conjunction with the accompanying drawings.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION

Figure 1:
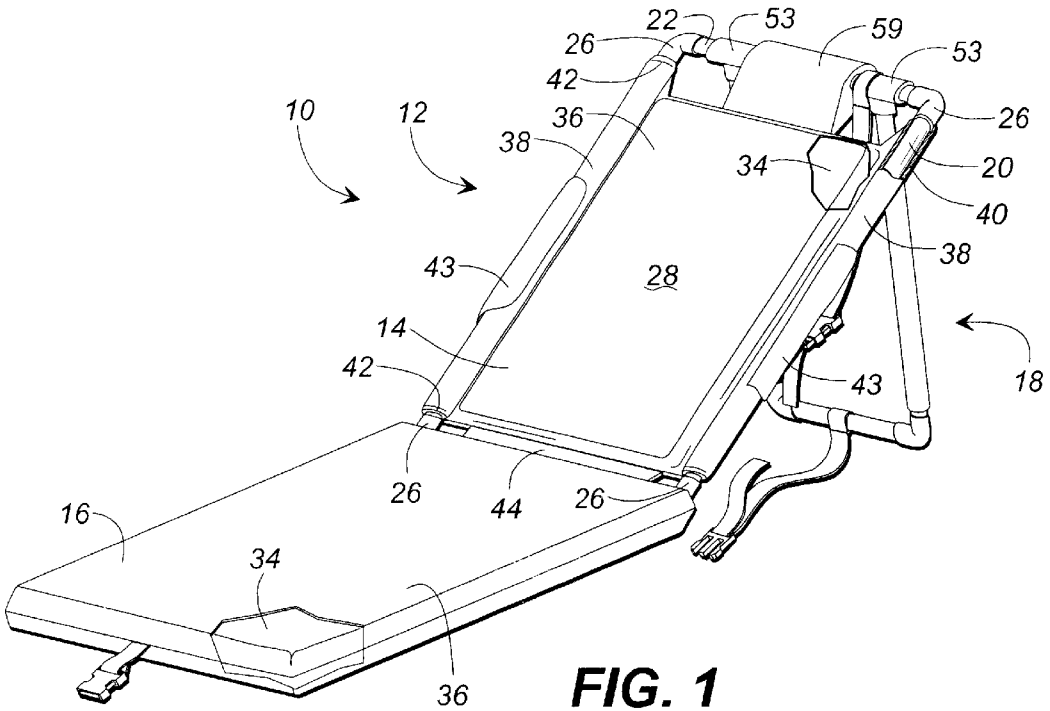
FIG. 1 is a front perspective view of a first embodiment of a foldable chair constructed in accordance with the present invention.

Referring now in more detail to the drawings, in which like numerals indicate like parts throughout the several views, FIGS. 1–6 illustrate a first embodiment of a foldable chair 10 constructed in accordance with the present invention. As shown in these figures, the foldable chair generally comprises a frame 12, an upper body support 14, a lower body support 16, and a frame support 18.

The frame 12 is normally formed of several elongated members. By way of example, the frame can be composed of a pair of opposed side members 20, an upper member 22, and a lower member 24. To reduce the weight of the frame 12 without a concomitant reduction in strength, these members are normally constructed out of cylindrical tubing. To maximize weight reduction and increase resistance to corrosion that could be caused by outdoor environments, the members 20, 22, and 24 are usually formed of polymeric tubing such as polyvinyl chloride ("PVC") tubing. Typically, each of the tubes is connected at both of its ends to an L-shaped member 26. These L-shaped members 26 join one tube to the next in the frame such that the members are arranged to form the general outline of a rectangle. The L-shaped members 26 are normally also composed of PVC tubing and are secured to the various other equivalent tubes with PVC glue or other adhesive so that the frame is substantially rigid and can adequately support the weight of the average user. Although normally fixed with PVC glue, it will be appreciated that various other equivalent conventional fixation methods could be used such as bonding, welding, fastening, threading, and the like.

The upper body support 14 is typically connected to the opposed side members 20 of the frame 12 and comprises a top side 28 and a bottom side 30. To increase the comfort of the chair, the upper body support 14 is provided with inner padding material 34. Normally, this padding material 34 comprises high density polymeric foam. Usually, two pieces of padding material are used in the lower body support (see lower body support 16), each piece having one side provided with a relatively tough, nonporous surface. When placed atop each other with these nonporous surfaces facing outwardly, a vapor barrier is formed which resists the entry of moisture into the padding material from the outside environment.

Encasing the padding material is a fabric covering 36. To decrease the permeation of water through the fabric, this fabric 36 is normally constructed of a synthetic material. Alternatively, where the chair will be used in very wet environments, this material 36 can comprise a substantially waterproof material such as Courdora® which is currently available from East Bank Trading Co. of Macon, Ga. The fabric can be dyed or otherwise colored with any color or pattern desired. When used for hunting, the fabric will normally have a camouflage pattern that suits the environment in which it will be used.

Figure 2:
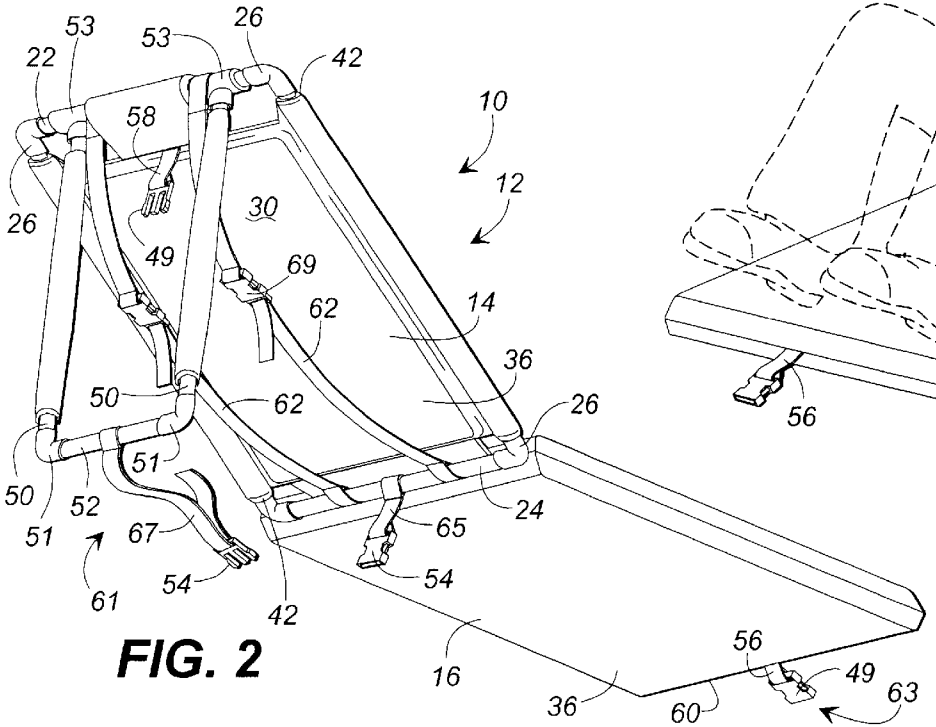
FIG. 2 is a rear perspective view of the chair shown in FIG. 1.

As shown in FIGS. 1 and 2, the upper body support 14 is provided with side portions 38 that each extend outwardly from the top side of the upper body support, around the side member 20, and to the bottom side 30 of the upper body support. The side portions 38 are constructed of a synthetic material similar to that used for the upper body support. The side portions surround padding material 40 that is disposed about the side members 20. Since the side portions 38 extend along substantially the entire length of the side members 20 of the frame, the side portions are normally elongated and substantially cylindrical in shape To secure the side portions in place on the side member, and to prevent dirt and other debris from collecting therebetween, each end of the cylindrical side portions 38 is provided with an elastic cuff 42. As an optional feature, each of the side portions further can be provided with utility pockets 43. When so provided, these pockets are typically constructed of the same fabric material used to construct the side portions. For purposes of compactness, the pockets 43 are collapsible against the side portions and can be retained in the collapsed position with fastening means such as buttons, snap fasteners, hook and loop fastening material, or the like (not shown). Of these fastening means, buttons are preferred because they can be manipulated with minimal sound being created.

Extending from the lower end of the upper body support 14 is a central web 44 of material that connects the upper body support 14 to the lower body support 16. Like the upper body support, the lower body support 16 is typically composed of interior padding material 34 and an exterior synthetic fabric 36. The padding material, like that of the upper body support, usually comprises two pieces of high density polymeric foam having nonporous surfaces that face outwardly within the lower body support. Normally, the fabric of the upper body support, the central web, and the lower body support are all made from a single piece of material such that the upper and lower body supports are manufactured in a unitary, one-piece construction. It will be understood, however, that each support could be separately manufactured and later connected with conventional methods such as by sewing or bonding.

Pivotally connected to the upper member 22 of the frame 12 is the frame support 18. Although capable of alternative construction, the frame support preferably comprises opposed elongated side members 50 and a base member 52 (FIG. 2). Typically, each of these members is composed of PVC tubing. Similar to the frame 12, the side members 50 are connected to the base member 52 with L-shaped members 51. These L-shaped members are also typically constructed of PVC tubing and normally are secured to the base and side members with PVC glue. Disposed at the ends of the side members 50 most distal to the base member 52 are T-shaped members 53. The T-shaped members are similarly constructed of PVC tubing and, like the L-shaped members, are fixed on the side members with PVC glue. As shown most clearly in FIGS. 1 and 2, the upper portion of each T-shaped member 53 is concentrically disposed about the upper member 22.

Figure 3:
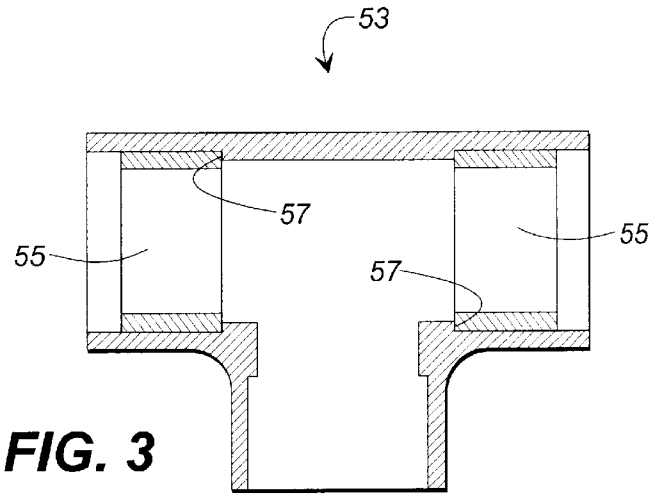
FIG. 3 is a side cross-sectional view of a T-shaped member used in the chair of FIG. 1.

To lower the tolerance between the T-shaped members 53 and the upper member 22 of the frame 12, the T-shaped members are preferably fitted with inner bushings 55, as shown in FIG. 3. Normally, one bushing 55 is placed in each end of the T-shaped member's upper tube, adjacent inner shoulders 57 within the T-shaped tube. Typically, the bushings 57 comprise short lengths of tubing such as PVC tubing. Because the bushings are sized to fit snugly within the T-shaped tubes, no glue or other fastening means are needed to secure the bushings to the T-shaped member. Arranged in this manner, the T-shaped members 53 and the remainder of the frame support 18 can pivot or rotate about the upper member 22 of the frame such that the frame support can be placed adjacent either side of the upper body support 14, or any position therebetween. Therefore, the frame support is free to rotate through nearly 360 degrees. For reasons that are explained below, the side members 50 are normally provided with padding material and fabric coverings similar to that of the upper and lower body supports.

Extending from the upper portion of the upper body support 14 is a head support 59. As depicted in FIGS. 1 and 2, the head support extends from the top side 28 of the upper body support 14, wraps about the upper member 22 of the frame 12 between the two T-shaped members 53 of the frame support, and attaches to the bottom side of the upper body support. Like the upper and lower body supports, the head support 59 normally comprise inner padding material covered with a synthetic fabric. In addition to providing support to the user's head, the head support 59 also acts as a spacer which maintains the frame side supports 50 in the correct, spaced relationship.

In addition to the above described primary components, the folding chair of the present invention normally includes a plurality of straps which improve its usefulness and functionality. The first of these straps is the frame support securing strap 61. This strap is connected at one end to the lower member 24 of the frame and to the base member 52 of the frame support at its other end, as illustrated in FIG. 2. Normally, the securing strap is adjustable and comprises two separate segments 65 and 67 that are releasably connectable to each other with a coupling member 54 that forms part of a quick release fastener. When adjusted to the proper length, the securing strap 61 ensures that the base 52 of the frame support 18 will not slip along the ground or floor surface upon which the chair is placed. Specifically, the strap secures the frame support 18 in proper position relative to the frame 12 when the chair is unfolded so that the desired angle of inclination of the upper body support is maintained.

Normally, the foldable chair is also provided with a lower body support retaining strap 63. Similar to the frame support securing strap 61, the retaining strap 63 is composed of two separate segments 56 and 58 that are attached to the lower body support (FIG. 1) and the upper body support (FIG. 2) respectively. Each of these segments is provided with a coupling member 49 that forms part of a second quick release fastener. The first segment 56 extends from a distal end 60 of the lower body support 16 and the second segment 58 extends from the bottom side 30 of the upper body support 14 adjacent the intersection of the head support 59 and the upper body support (FIG. 2). As is discussed in more detail below, the two segments are only joined together when the chair is folded for transportation.

In addition to the above described straps, the foldable chair of the present invention preferably includes a pair of adjustable shoulder straps 62 shown in FIG. 2. These straps extend from the upper member 22 of the frame to the lower member 24 of the frame. Like the other straps mentioned above, the shoulder straps 62 are formed of two segments that are releasably joined together with quick release fasteners 69. As described below, these shoulder straps permit the user to easily carry the folded chair on his or her back for hands-free transport.

Figure 4:
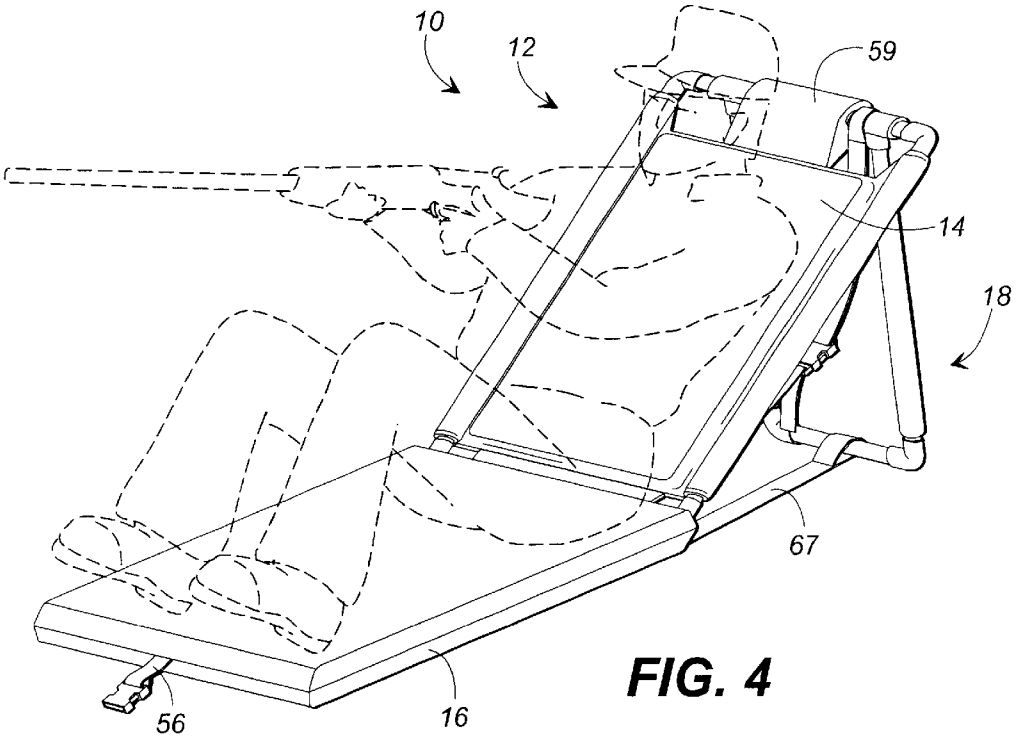
FIG. 4 is a front perspective view of the chair of FIG. 1 shown with a user seated in the chair.

So described, the foldable chair of the present invention can be used as a portable body support. In particular, the user can sit down on the lower body support 16 with his or her back resting on the upper body support 14 as shown in FIG. 4. When so seated, the user's back is supported at an angle approximately between 40 and 60 degrees with respect to the ground or floor surface depending upon the adjustment made to the frame support securing strap 61. If desired, the user can rest his or her head on the head support 59 that extends upwardly from the upper body support.

Figure 5:
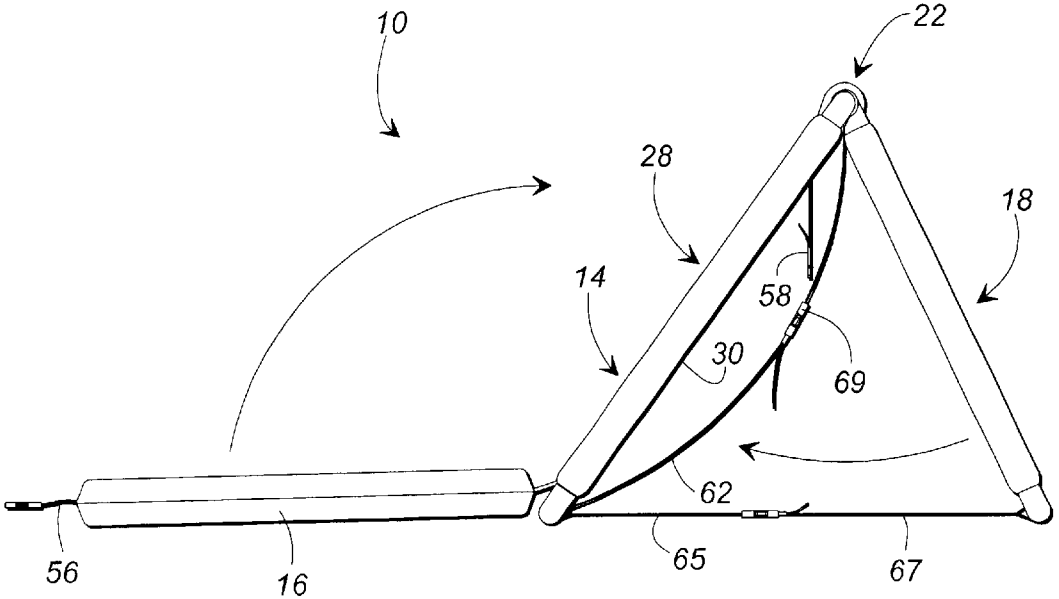
FIG. 5 is a side view indicating the manner of folding the chair of FIG. 1.

As mentioned briefly above, the foldable chair of the present invention is particularly useful for outdoor sports such as hunting as indicated in FIG. 4. When used for hunting, the chair provides a comfortable, warm, and dry surface to sit on. Moreover, the slightly reclined position of the first embodiment of the foldable chair is particularly well suited for turkey hunting as indicated in FIG. 4. When hunting, the user can quickly move to a new location by folding the chair, moving to the new area, and resetting the chair. As illustrated in FIG. 5, the chair is typically folded up by simply rotating the frame support 18 about the upper member 22 of the frame until it rests against the bottom surface 30 of the back support. Next, the lower body support 16 can be folded upwardly toward the upper body support 14 until the lower body support comes into contact with the top side 28 of the upper body support. To retain the chair in the folded position, the individual segments 56 and 58 of the lower body support retaining strap are secured to one another with the quick release fastener. To later unfold the chair, the user simply extends the frame support, uncouples the segments 56 and 58 of the retaining strap fastener, and drops the lower body support 16 to the ground. Easily folding and unfolding in this manner, the foldable chair of the present invention allows the hunter to quickly and silently set up, pack up, move, and set up again without causing a substantial disturbance. As will be appreciated by those having ordinary skill in the art, the quietness with which the chair can be used is substantially improved when quick release fasteners and buttons are used as opposed to snap fasteners and hook and loop fastening material.

Figure 6:
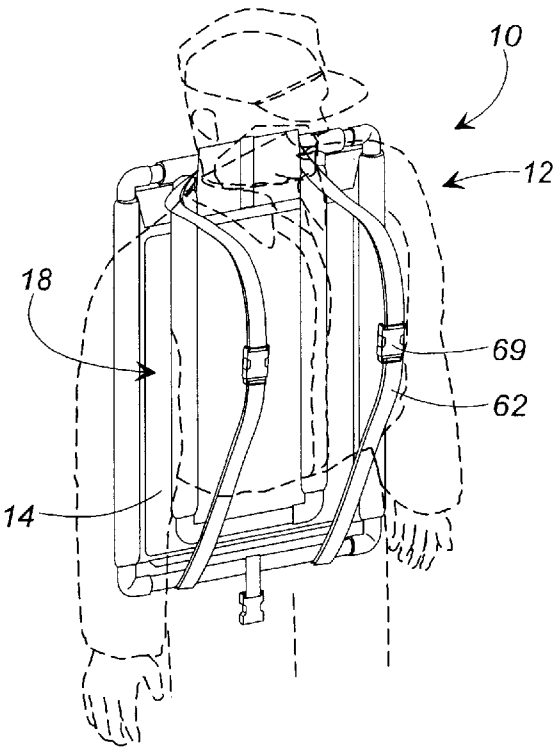
FIG. 6 is a side perspective view of the chair of FIG. 1 placed on the back of the user.

To simplify transport of the chair, the adjustable shoulder straps 62 can be utilized to carry the chair on the user's back. FIG. 6 illustrates the foldable chair 10 placed upon the user's back. As indicated in this figure, the bottom surface 30 of the upper body support is arranged adjacent the user's back with the shoulder straps 62 looped around the user's shoulders. When so positioned, the foldable chair can be carried similar in nature to a conventional backpack. Since the materials used to form the chair have been selected for their light weight, the user can easily carry the chair in this manner for long periods of time with little fatigue and with little interference to his or her freedom of movement. Therefore, a hunter, for example, can easily carry the chair as well as any guns or other equipment needed for the hunt. Moreover, since the side members of the frame support are provided with padding material, the user experiences no discomfort when the chair is carried but still can quickly extend the frame support 18 to set up the chair. Additionally, since the shoulder straps are adjustable, the chair can even be placed over top a smaller backpack, if desired. In that these straps are looped around the frame members, as opposed to being sewn to the body supports, the straps are more durable and unlikely to detach from the chair when used.

Figure 7:
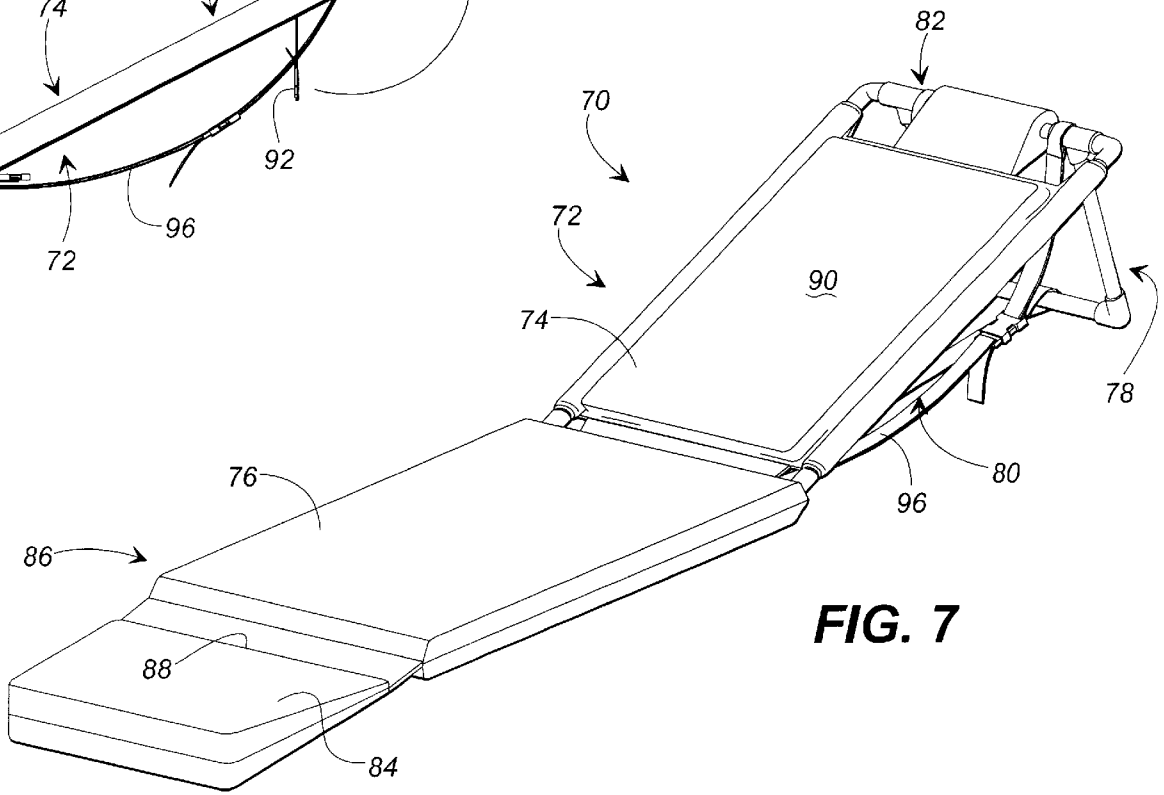
FIG. 7 is a front perspective view of a second embodiment of a foldable chair constructed in accordance with the present invention.
Figure 9:
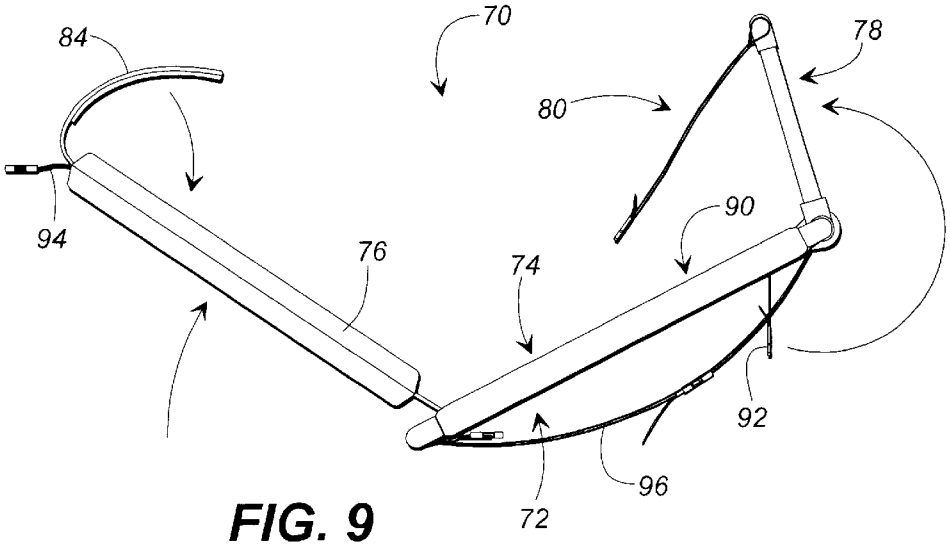
FIG. 9 is a side view indicating the manner of folding the chair of FIG. 7.
Figure 8:
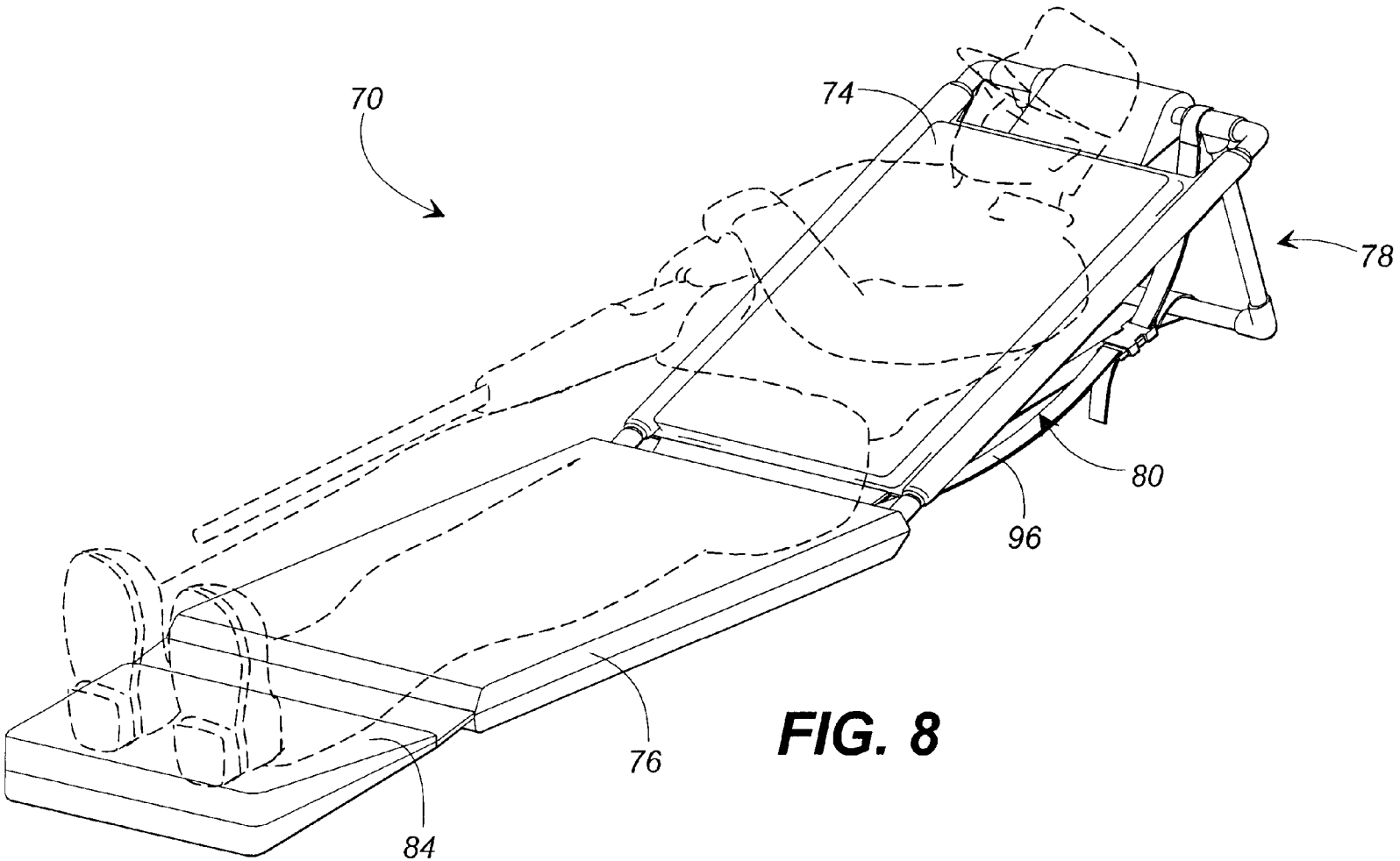
FIG. 8 is a front perspective view of the chair of FIG. 7 shown with a user seated in the chair.

FIGS. 7–9 illustrate a second embodiment of a foldable chair 70 constructed in accordance with the present invention. As shown in these figures, this foldable chair is substantially similar in construction to that of the first embodiment. Therefore, the following disclosure will briefly describe the components of the foldable chair 70. A more detailed description is reserved only for structures or features specific to the second embodiment alone.

The foldable chair 70 of the second embodiment generally comprises a frame 72, an upper body support 74, a lower body support 76, and a frame support 78. Each of these components is similar in construction to the like named components found in the chair of the first embodiment except for the frame support 78. As indicated in FIG. 7, the frame support 78 of the second embodiment is substantially shorter in length than that of the first embodiment. This shorter length results in a more reclined seating position that is particularly well suited for hunting goose and duck. Specifically, when in the unfolded position, the upper back support forms an angle of approximately between 0 and 30 degrees with the ground or floor surface. In addition, no padding material is provided on the side tubes of the frame support 78 for reasons explained below. Other than these differences, the frame support functions in the same way as that of the first embodiment. Accordingly, the frame support 78 is normally secured to the frame with a frame support strap 80 and is fully pivotable about the upper member 82 of the frame for folding of the chair.

Unlike the foldable chair shown in FIGS. 1–6, the foldable chair 70 of the second embodiment is further provided with a utility pouch 84. This pouch is attached to the distal end 86 of the lower body support 76 and is typically accessible through an elongated opening 88 provided adjacent this attachment point. The utility pouch is substantially waterproof and therefore can be used to hold a variety of items including, but not limited to, cameras, film, food, ammunition, killed prey, and the like. As is evident from the discussion below, this pouch can be used both when the chair is fully unfolded for use and when the chair is folded for transportation.

When set up, the chair 70 of the second embodiment can be used by hunters to fully recline until the hunter's back is nearly parallel to the ground as indicated in FIG. 8. When a bird passes by, the hunter can quickly sit up and shoot. Since the hunter's back is raised slightly above ground, it is believed that quicker responses, and therefore more successful hunting, can be achieved with the chair of the second embodiment than without.

As illustrated in FIG. 9, the chair of the second embodiment is typically folded up by decoupling the frame support securing strap 80 and then rotating the frame support 78 about the upper member 82 of the frame 72. Since speed in set up is not critical when hunting goose or duck, the frame support 78 is fully pivoted in the opposite direction as that of the first embodiment until it comes into contact with the top surface 90 of the upper body support 74. For this reason, padding is not needed for the frame support. Before folding the lower body support upward toward the upper body support, the utility pouch 84 is folded inwardly in the direction indicated in FIG. 9. If items are stored in the pouch, the user must be careful not to spill the contents of the pouch when making the fold. To prevent such spillage, the opening of the pouch can be provided with conventional closure means such as buttons (not shown). Once the pouch is completely folded over, the lower body support can be folded upwardly until it nearly comes into contact with the upper body support and substantially encapsulates the frame support therebetween. As in the first embodiment, the chair can then be retained in the folded position with the individual segments 92 and 94 of the lower body support retaining strap. The chair is then prepared for transport on the user's back in similar fashion as described above with respect to the first embodiment. Therefore, adjustable shoulder straps 96, connected to the upper and lower members of the frame, are used to carry the chair on the user's back.

Figure 10:
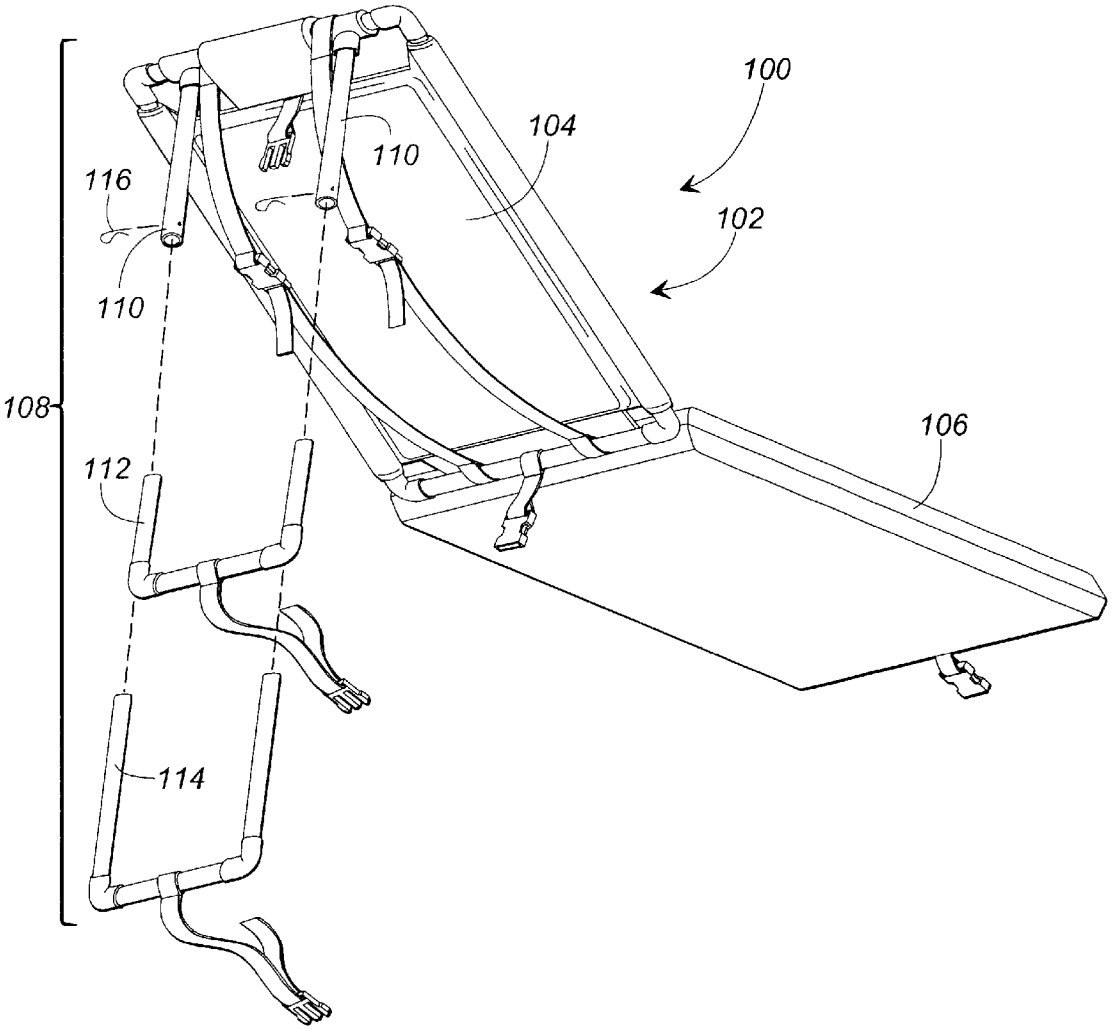
FIG. 10 is an exploded rear perspective view of a third embodiment of a foldable chair constructed in accordance with the present invention.

FIG. 10 illustrates a third embodiment of a foldable chair 100 constructed in accordance with the present invention. This foldable chair is substantially similar in construction to that of the first and second embodiments and, therefore, the following disclosure is focused on structures or features specific to the third embodiment alone.

Like that of the first two embodiments, the foldable chair of the third embodiment generally comprises a frame 102, an upper body support 104, a lower body support 106, and a frame support 108. Each of these components is similar in construction to the like named components found in the chair of the first embodiment except for the frame support 108. As shown in FIG. 10, the frame support 108 of the third embodiment is adjustable. In particular, the frame support 108 comprises upper tube portions 110 and a pair of interchangeable U-shaped portions 112 and 114 that are each adapted to connect to the upper tube portions 110. When connected to the upper tube portions, the U-shaped portions can be individually releasably secured thereto with a conventional fastener such as a cotter pin 116. Although cotter pins are preferred, it will be appreciated that other releasable fastening means could be used including screws, bolts, biased detents, and the like.

Having two interchangeable U-shaped portions 112 and 114 permits the user to change the inclination of the upper body support 104 of the chair depending upon the user's particular needs. For example, if the user is a hunter and wishes to go turkey hunting, he or she would then choose the relatively large U-shaped portion 114 to provide a substantially upright seating position. If, on the other hand, the hunter would like to go goose or duck hunting, he or she would instead choose the relatively smaller U-shaped portion 112 to obtain a substantially supine seating position.

While preferred embodiments of the invention have been disclosed in detail in the foregoing description and drawings, it will be understood by those skilled in the art that variations and modifications thereof can be made without departing from the spirit and scope of the invention as set forth in the following claims. For instance, although the foldable chair of the present invention is described primarily in association with outdoor activities such as hunting, it will be understood that the chair can be used indoors, especially when it is desired to have a chair that can be easily stored away when not in use.

What is claimed is:

1. A foldable chair, comprising:

a substantially rigid frame having an upper member, a lower member, and opposed side members;

an upper body support having a top side and a bottom side, said upper body support being connected to said frame;

a lower body support having a top side, a bottom side, a proximal end, and a distal end, said lower body support being attached to said upper body support at said proximal end; and a substantially rigid frame support, said frame support being pivotally connected to said upper member of said frame with a pair of T-shaped members, each T-shaped member having at least one bushing contained therein for lowering the tolerance between said upper member of the frame and said T-shaped members;

wherein said frame support can be pivoted relative to said upper member of said frame to lie against said upper body support and wherein said lower body support can be folded up against said top side of said upper body support so that said chair can be easily transported.

2. The foldable chair of claim 1, wherein said upper, lower, and side members of said frame are elongated and substantially cylindrical in shape.

3. The foldable chair of claim 2, wherein said upper, lower, and side members of said frame are constructed of polymeric tubing.

4. The foldable chair of claim 1, wherein said upper body support connects to said frame at said side members.

5. The foldable chair of claim 1, wherein said lower body support and said upper body support are provided with padding material to cushion the user.

6. The foldable chair of claim 5, wherein said padding material comprises two panels of polymeric foam, each panel having a relatively tough, nonporous surface that faces outwardly.

7. The foldable chair of claim 1, further comprising a pair of shoulder straps having first and second ends, said first ends being connected to said upper member of said frame and said second ends being connected to said lower member of said frame, wherein said foldable chair can be carried on the user's back by securing it to the user's upper body with said shoulder straps.

8. The foldable chair of claim 1, further comprising padding material disposed about said opposed side members of said frame.

9. The foldable chair of claim 1, further comprising securing means for securing said frame support in proper position relative to said frame when said chair is unfolded.

10. The foldable chair of claim 9, wherein said securing means comprises a frame support securing strap connected at its first end to said lower member of said frame and connected at its second end to said frame support.

11. The foldable chair of claim 1, further comprising lower body support retaining means for retaining said lower body support against said front side of said upper body support when said chair is folded.

12. The foldable chair of claim 11, wherein said retaining means comprises a lower body support retaining strap connected at its first end to said lower body support and connected at its second end to the rear side of said upper body support.

13. The foldable chair of claim 1, wherein said frame support comprises a pair of elongated side members and a base member which connects to both of said elongated side members.

14. The foldable chair of claim 13, wherein said elongated side members are separated on said upper member of said frame by said head support.

15. The foldable chair of claim 1, wherein said frame support is adjustable in length.

16. The foldable chair of claim 15, wherein said frame support comprises upper tube portions and a substantially U-shaped portion that secures to said upper tube portions with releasable fasteners.

17. The foldable chair of claim 16, wherein said fasteners are cotter pins.

18. The foldable chair of claim 1, further comprising a utility pouch attached to said distal end of said lower body support and extending longitudinally therefrom, wherein said utility pouch folds back between said lower body support and said upper body support when said chair is folded.

19. A method for folding and transporting a body support comprising a frame, an upper body support, a lower body support, a frame support, and a pair of shoulder straps, said method comprising the steps of:

rotating the frame support about an upper member of the frame until the frame support comes into contact with a top surface of the upper body support;

folding the lower body support upwardly toward the upper body support until the lower body support is adjacent the top surface of the upper body support and substantially encapsulates the frame support therebetween;

retaining the chair in the folded position with retaining means; and securing the folded chair on a person's back with the shoulder straps such that the person can easily carry the chair on his or her back with little fatigue and with little interference to his or her freedom of movement.

20. The method of claim 19, wherein the chair includes a head support.

21. The method of claim 20, wherein the head support extends around the frame and is connected to the upper body support.

22. The method of claim 19, wherein the upper and lower body supports include two panels of polymeric foam, each panel having a relatively tough, nonporous surface that faces outwardly.

23. The method of claim 19, wherein the shoulder straps are connected to the frame.

24. The foldable chair of claim 1, further comprising a head support that extends around said upper member of said frame and connects to said upper body support.

25. The method of claim 20, wherein the upper body support is connected to said frame.

26. The method of claim 25, wherein the lower body support is attached to the upper body support at a proximal end of the lower body support.

* * * * *